United States Patent [19]

Schütz

[11] 4,171,751

[45] Oct. 23, 1979

[54] COMPOSITE STEEL-JACKETED PLASTIC BARREL

[76] Inventor: Udo Schütz, Ruckersteg 4, 5418 Selters, Westerwald, Fed. Rep. of Germany

[21] Appl. No.: 911,108

[22] Filed: May 31, 1978

[30] Foreign Application Priority Data

Jan. 7, 1978 [DE] Fed. Rep. of Germany ..... 2800627

[51] Int. Cl.[2] ..... B65D 25/14

[52] U.S. Cl. ..... 220/468; 220/5 R; 220/72; 220/94 A; 220/466

[58] Field of Search ..... 220/465, 466, 468, 453, 220/72, 5 R, 94 A, 71

[56] References Cited

U.S. PATENT DOCUMENTS

| | | | |
|---|---|---|---|
| 1,331,409 | 2/1920 | Barnett | 220/94 A |
| 1,969,120 | 8/1934 | Coakley | 220/466 X |
| 2,013,327 | 9/1935 | Wilkins | 220/446 |
| 2,054,754 | 9/1936 | Kellogg | 220/465 |
| 3,207,359 | 9/1965 | Heisler et al. | 220/94 A X |
| 3,219,230 | 11/1965 | Housz et al. | 220/465 X |
| 3,220,602 | 11/1965 | Ficker | 220/453 |
| 3,985,257 | 10/1976 | Shaffer et al. | 220/72 X |
| 4,033,473 | 7/1977 | Raley et al. | 220/5 R X |

FOREIGN PATENT DOCUMENTS

| | | | |
|---|---|---|---|
| 115309 | 6/1929 | Austria | 220/5 R |
| 232915 | 8/1963 | Austria | 220/72 |

*Primary Examiner*—Allan N. Shoap
*Attorney, Agent, or Firm*—Young & Thompson

[57] ABSTRACT

A composite steel-jacketed plastic barrel comprises a blow-molded inner container of synthetic resin that has external peripheral ribs molded integrally thereon and projecting flanges at its opposite ends. The side wall of the inner container is thinnest adjacent its midsection and progressively increases in thickness toward its ends. The steel jacket has inwardly opening peripheral crimps into which the ribs of the inner container snap, and end edges that are rolled over the end flanges of the inner container.

3 Claims, 1 Drawing Figure

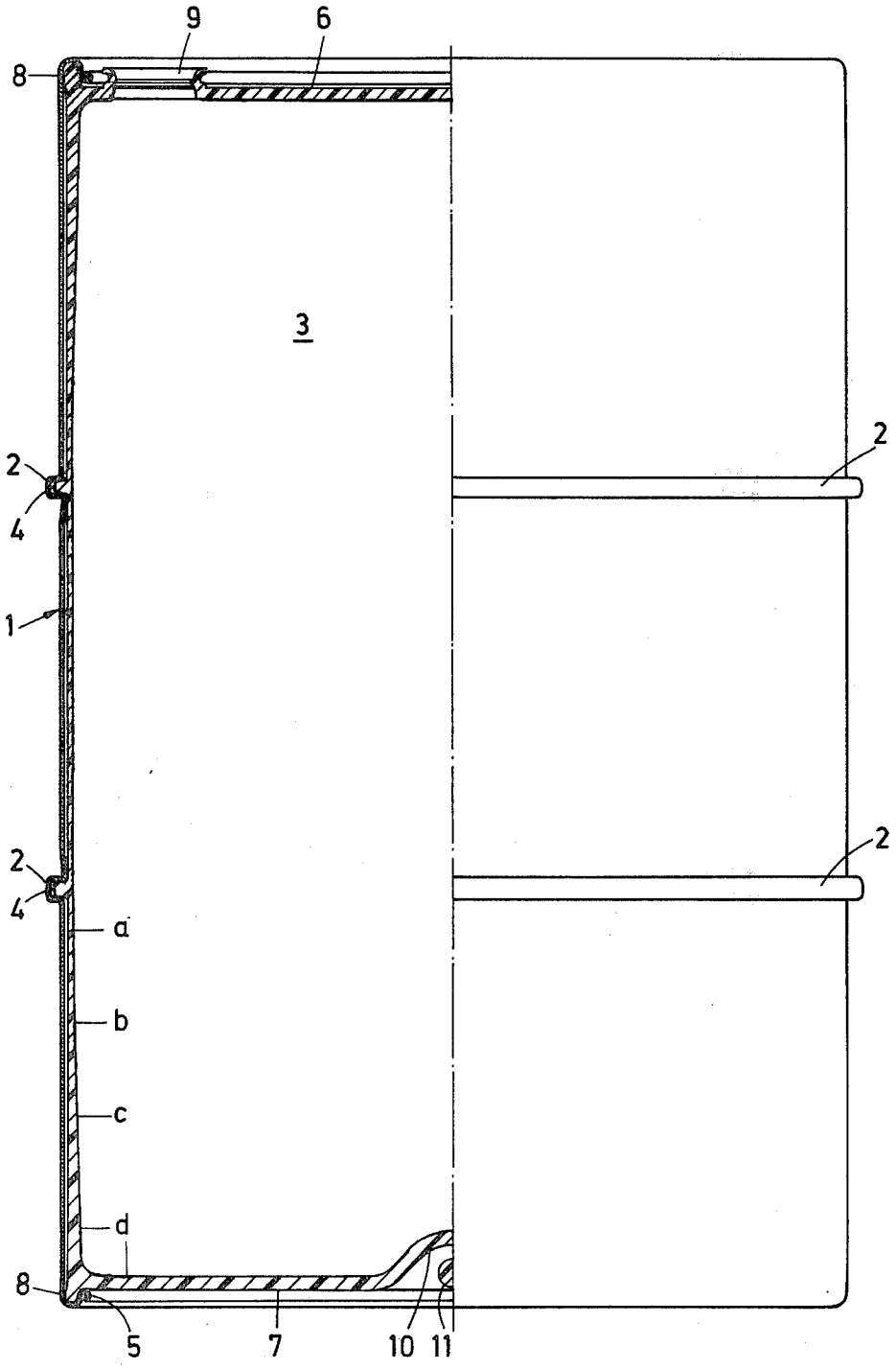
9
6
8
3
2
2
4
1
2
2
4
a
b
c
d
8
5
7
10
11

COMPOSITE STEEL-JACKETED PLASTIC BARREL

The invention relates to a spigoted container with a jacket of steel sheet, having two outwardly projecting peripheral crimps as well as a rolled edge at the bottom rims.

The normal spigoted containers or barrels in accordance with the API standards are unsuitable for corrosive substances, so that in many cases different types of shipping means must be used for this purpose. However, this also requires the use of different filling devices, transportation and stacking equipment, as well as different units of quantity.

The invention has as its object the provision of a normal spigoted container conforming to API standards, for example of a size of 55 U.S. gallons, in which it is possible to fill such container even with corrosive substances which otherwise would attack the metal of the container.

This object has been attained according to this invention by providing an inner container blown integrally of a synthetic resin which is locked with reinforcing ribs produced by pressing during the molding step into the peripheral crimps of the steel jacket. The container end faces have integrally molded spigot openings. The inner container is connected with the rolled rims of the steel jacket by mating formations and has a wall thickness which increases from the central cross-sectional zone of the container toward the end faces.

Preferably, a recess with a hand grip is molded into one of the container end faces for the manipulation of the inner container relative to the jacket of steel sheet.

The wall thickness of the inner container of synthetic resin can be, in the region of the container end faces, approximately four times the wall thickness at half the height of the container.

The spigoted container according to the invention corresponds exactly to the standardized steel barrel dimensions and thus requires no change in the existing handling means for such containers or barrels, such as, for example, barrel grippers, stacking devices, filling stations, roller conveyors, etc. Due to the exactly metered amount of material consumed for production of the inner synthetic resin container, the advantages enjoyed are, on the one hand, that the manufacturing costs are hardly higher than in connection with barrels made entirely of steel, and, on the other hand, that the container end faces of the inner synthetic resin container are fashioned as rigid discs and the ability to stack the container is preserved due to the steel jacket. The novel spigoted container thus fulfils a long-felt commercial need.

The drawing shows an embodiment of a composite spigoted container according to the invention, the left half thereof being shown in cross section.

The illustrated spigoted container consists of a jacket 1 of steel sheet with outwardly projecting peripheral crimps 2 as well as of an inner container 3 of polyethylene which has reinforcing hoops or ribs 4 compressed of synthetic resin material blown into appropriate annular chambers by the displacement of blow mold segments. These ribs are arranged so that when the inner container 3 is pulled into the steel jacket 1, the reinforcing ribs 4 are locked into the peripheral crimps 2, establishing a hardly releasable, shape-mating connection between the inner container 3 and the steel jacket 1. A rim 5 is rolled, after inserting the inner container 3, over projecting flanges or beads 8 of the end faces 6 and 7. An alternative edge reinforcement can also be provided by steel sheet hoops (not shown) attached by pressing or rolling onto corresponding flange-like extensions (not shown) on the steel jacket 1 and similarly locking in place the inner container 3.

The wall thickness of the inner container 3 of polyethylene increases from the middle of the length of the container to both end faces 6, 7 by about fourfold, so that, for example, a wall thickness of 1 mm. is provided in zone a, a wall thickness of 2 mm. in zone b, a wall thickness of 3 mm. in zone c, and a wall thickness of 4 mm. in zone d and in the end faces 6, 7. The stacking strength (it is possible to stack at least four containers on top of one another) is ensured by the steel jacket 1, so that a relatively small wall thickness of the inner container of polyethylene is sufficient in middle zone a whereas the thick cross sections of end faces 6, 7 obviate the need for separate end plates of steel sheet, thus saving this expense, so that the composite container fashioned in this way is hardly any more expensive than the normal spigoted barrels of steel sheet, especially since it is possible to mold also the spigot openings 9 (one of which is shown) integrally in the homogeneous inner polyethylene container during the blow-molding thereof.

In order to make it possible to pull the inner polyethylene container 3 into the steel jacket 1 by means of a hydraulic device, for example, a recess 10 is molded in one of the end faces, for example 7, which has no spigot openings 9. An integrally molded handle 11 extends across recess 10 and can be coupled to a piston of the hydraulic device or the like, this piston drawing the inner container from above (as seen in the drawings) downwardly into the jacket, during which step the reinforcing ribs 4 of the inner container 3 lock with a snap action into the peripheral crimps 2 of the steel jacket 1. It is of course to be understood that the movement of the inner container 3 relative to the steel jacket 1 during joining is not limited to the afore-described direction of drawing 3 into 1. It is also to be understood that rims 5 are formed by conventional rolling methods only after container 3 has been correctly positioned in jacket 1.

I claim:

1. A composite container comprising a jacket of steel sheet having at least one inwardly opening outwardly extending peripheral crimp therein spaced between its ends, an inner container of synthetic resin having at least one peripheral outwardly extending integral, preformed rib disposed in said at least one crimp of said steel jacket and mated thereto with a snap action, the inner container having integral, preformed end flanges and the steel jacket having end edges that are rolled over and receive and retain said flanges and that terminate adjacent said flanges, said inner container having exposed integral closed ends with at least one opening therethrough for filling and emptying the container, the wall thickness of said inner container increasing from the mid-portion of the container toward both ends of the container.

2. A container as claimed in claim 1, in which the wall thickness of the inner container adjacent the ends thereof is about four times the wall thickness of the inner container adjacent the midportion thereof.

3. A container as claimed in claim 1, and a recess in an end of the inner container, and a handle extending across said recess.

* * * * *